US009416757B2

(12) United States Patent
Pettersson

(10) Patent No.: US 9,416,757 B2
(45) Date of Patent: Aug. 16, 2016

(54) AIR FILTER ARRANGEMENT AND CONNECTING DUCT

(71) Applicant: Scania CV AB, Södertälje (SE)

(72) Inventor: Emil Pettersson, Tystberga (SE)

(73) Assignee: SCANIA CV AB (SE)

( * ) Notice: Subject to any disclaimer, the term of this patent is extended or adjusted under 35 U.S.C. 154(b) by 103 days.

(21) Appl. No.: 14/380,758

(22) PCT Filed: Feb. 25, 2013

(86) PCT No.: PCT/SE2013/050162

§ 371 (c)(1),
(2) Date: Aug. 25, 2014

(87) PCT Pub. No.: WO2013/129998

PCT Pub. Date: Sep. 6, 2013

(65) Prior Publication Data

US 2015/0007529 A1 Jan. 8, 2015

(30) Foreign Application Priority Data

Mar. 1, 2012 (SE) ..... 1250193

(51) Int. Cl.
*F02M 35/02* (2006.01)
*F02M 35/024* (2006.01)
*F02M 35/10* (2006.01)

(52) U.S. Cl.
CPC ..... *F02M 35/0209* (2013.01); *F02M 35/0204* (2013.01); *F02M 35/02416* (2013.01); *F02M 35/10137* (2013.01); *F02M 35/02483* (2013.01)

(58) Field of Classification Search
CPC .... B01D 46/00; B01D 46/10; B01D 46/0005; F02M 35/024; F02M 35/0203; F02M 35/0205
USPC ..... 55/385.3, 480, 493, 495, 502, 503, 505; 123/198 E
See application file for complete search history.

(56) References Cited

U.S. PATENT DOCUMENTS 8,337,579 B2 * 12/2012 Alexander ..... B01D 46/0004 123/198 E
8,394,158 B2 * 3/2013 Shimomura ..... F02M 35/0203 55/385.3
8,728,188 B2 * 5/2014 Kim ..... A47L 5/362 55/429

(Continued)

FOREIGN PATENT DOCUMENTS

FR 1 444 034 7/1966

OTHER PUBLICATIONS

International Search Report mailed May 28, 2013 in corresponding PCT International Application No. PCT/SE2013/050162.

*Primary Examiner* — Duane Smith
*Assistant Examiner* — Minh-Chau Pham
(74) *Attorney, Agent, or Firm* — Ostrolenk Faber LLP

(57) ABSTRACT

An air filter arrangement has a filter housing (10) for connection to a duct (80) for a combustion engine. The filter housing (10) has a cover (30) for closing a top aperture of the filter housing (10). An engine air outlet (40) is on the cover (30). A flexible pipe section (42) on the engine air outlet and for connection to the duct, the flexibility to allow the cover (30) to be removed from the top aperture and a filter unit to be introduced into or taken out from the filter housing (10).

6 Claims, 4 Drawing Sheets

(56) References Cited

U.S. PATENT DOCUMENTS

| | | | | |
|---|---|---|---|---|
| 8,741,017 | B2 * | 6/2014 | Nelson | B01D 46/0005 55/493 |
| 8,915,985 | B2 * | 12/2014 | Dewit | B01D 46/00 55/357 |
| 2003/0029145 | A1 | 2/2003 | Sudoh | 55/418 |
| 2007/0240393 | A1 | 10/2007 | Dworatzek et al. | 55/495 |
| 2007/0251392 | A1 | 11/2007 | Tschech et al. | 96/147 |
| 2008/0282654 | A1 | 11/2008 | Matschl et al. | 55/385.3 |
| 2009/0019710 | A1 | 1/2009 | Grossman et al. | 30/390 |

* cited by examiner

AIR FILTER ARRANGEMENT AND CONNECTING DUCT

CROSS-REFERENCE TO RELATED APPLICATIONS

The present application is a 35 U.S.C. §§371 national phase conversion of PCT/SE2013/050162, filed Feb. 25, 2013, which claims priority of Swedish Patent Application No. 1250193-8, filed Mar. 1, 2012, the contents of which are incorporated by reference herein. The PCT International Application was published in the English language.

TECHNICAL FIELD

The invention relates to an air filter arrangement comprising a filter housing for connection to a duct for air to a combustion engine. The invention relates also to a connecting duct for such an air filter arrangement.

BACKGROUND

In known air filter arrangements for a combustion engine, particularly an engine of a truck the filter housing often has a releasable bottom which allows a spent filter unit to be taken out and replaced from below, i.e. from the dirty lower side of the arrangement. Although the filter change takes place from the dirty side, there is still risk that in the limited space under the vehicle the new filter unit may scrape against the dirty region in and outside the filter housing, potentially leading to dirt making its way into the filter unit and thereby to the clean side of the air system, and hence to possible damage to the engine. Such a filter change also involves a considerable amount of work and use of space, particularly as the vehicle has to be raised or placed over a greasing pit or the like in a workshop to provide space for the work involved in the change. The operation may comprise removing the bottom of the filter housing, taking out the spent filter unit, cleaning the inside and bottom of the housing, inserting the new filter unit and refitting the bottom.

It would therefore be desirable to be able to change the filter from the upper side of the filter housing.

SUMMARY OF THE INVENTION

An object of the invention is to propose a filter arrangement of the kind indicated in the introduction wherein the filter unit can be changed in a simpler way, with little risk of contamination of the clean side of the filter arrangement.

In one aspect of the invention the arrangement has a cover for closing a top aperture of the filter housing, an engine air outlet on the cover and a flexible pipe section on the engine air outlet for the connection to the duct, to allow the cover to be removed from the top aperture and a filter unit to be introduced into and taken out of the filter housing when the housing is connected to the duct.

This arrangement thus makes it possible for the filter unit to be changed from the upper side of the arrangement without removing the closed duct system between the filter housing and the engine, thus facilitating the work and avoiding the need to raise the vehicle or place it on a greasing bridge or over a greasing pit.

In one embodiment the pipe section is deformable like a roll bellows. This makes it possible for it to be turned inside out, possibly with manual assistance from the service technician undertaking the filter change, and thus be shortened so that the cover can be moved away from the top aperture of the filter housing.

If the flexible pipe section has a narrowing cross-section in a direction of flow, the turning inside out may be facilitated so that the larger cross-section nearest to the cover will be on top of the narrower cross-section nearest to the duct to the engine.

The flexible pipe section may further be adapted to being slid over the engine air outlet and the duct, making it possible for it to be supported by them so that it does not collapse during operation. An end portion of the duct may then also serve as unrolling support for the flexible pipe section when the cover is opened for filter change or other servicing.

The pipe section may further have a curved portion. Configuring the pipe section in a suitable way will then it make it possible to pivot the cover up from the filter housing to leave space for filter change.

The cover may then be connected to the filter housing via a hinge.

For adaptation to the hinge, a middle line of the curved portion may run at approximately constant distance from the hinge.

The engine air outlet may then also be covered by a filter element. Such a filter element, which may comprise a filter cloth or a fine-mesh grille on the cover, provides protection against contamination of the clean side with the ducts to the engine when the cover is removed for filter change.

Other features and advantages of the invention may be indicated by the claims and the description of an embodiment example set out below.

DETAILED DESCRIPTION OF EMBODIMENTS

Figure 1:
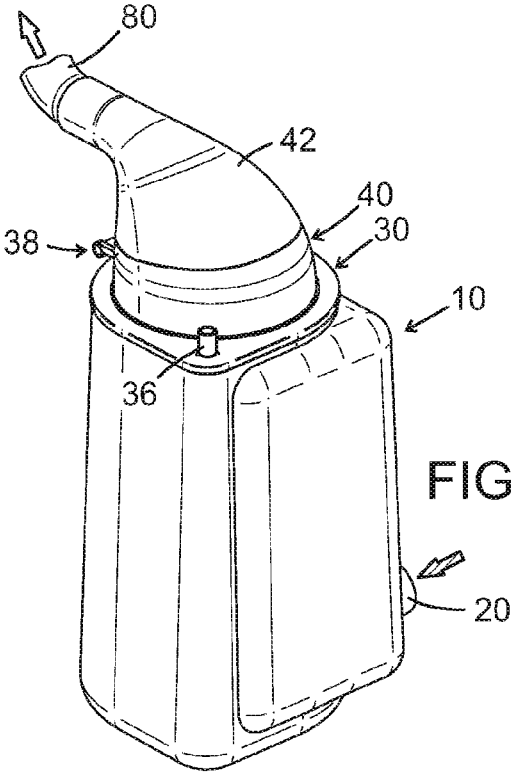
FIG. 1 is a view obliquely from above of an air filter arrangement according to the invention.
Figure 2:
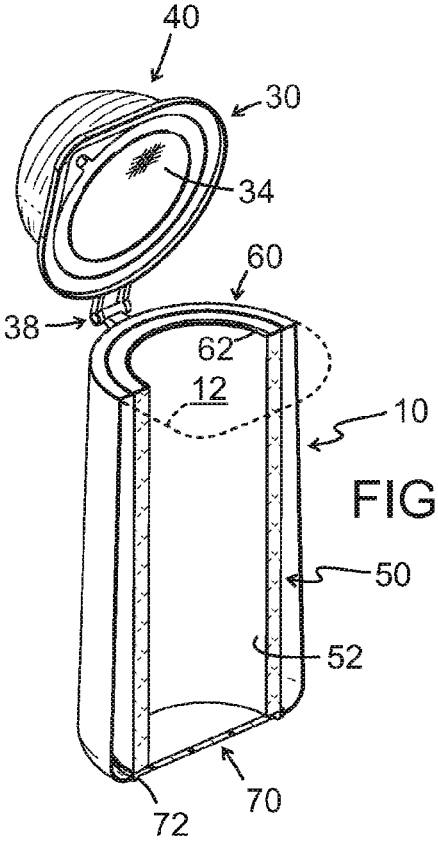
FIG. 2 is a longitudinal sectional view corresponding to FIG. 1 with cover open.

Throughout the drawings, the same reference numerals are used for items with same or similar functions.

The air filter arrangement depicted in the drawings comprises in a known way an elongate air filter housing 10 for accommodating a filter unit or cartridge 50 comprising a substantially semicylindrical air filter 52. Air which is to be filtered passes through an air inlet 20 (FIG. 1) on the outside of the filter housing 10 into an annular space between the filter unit 50 and the filter housing 10 and, after passing through the filter 52, proceeds through an engine air outlet 40 in a cover 30 on the upper side of the filter housing 10. This engine air outlet 40 is itself intended to be connected to an undepicted air intake of a combustion engine via successive air ducts 42, 80.

Figure 4:
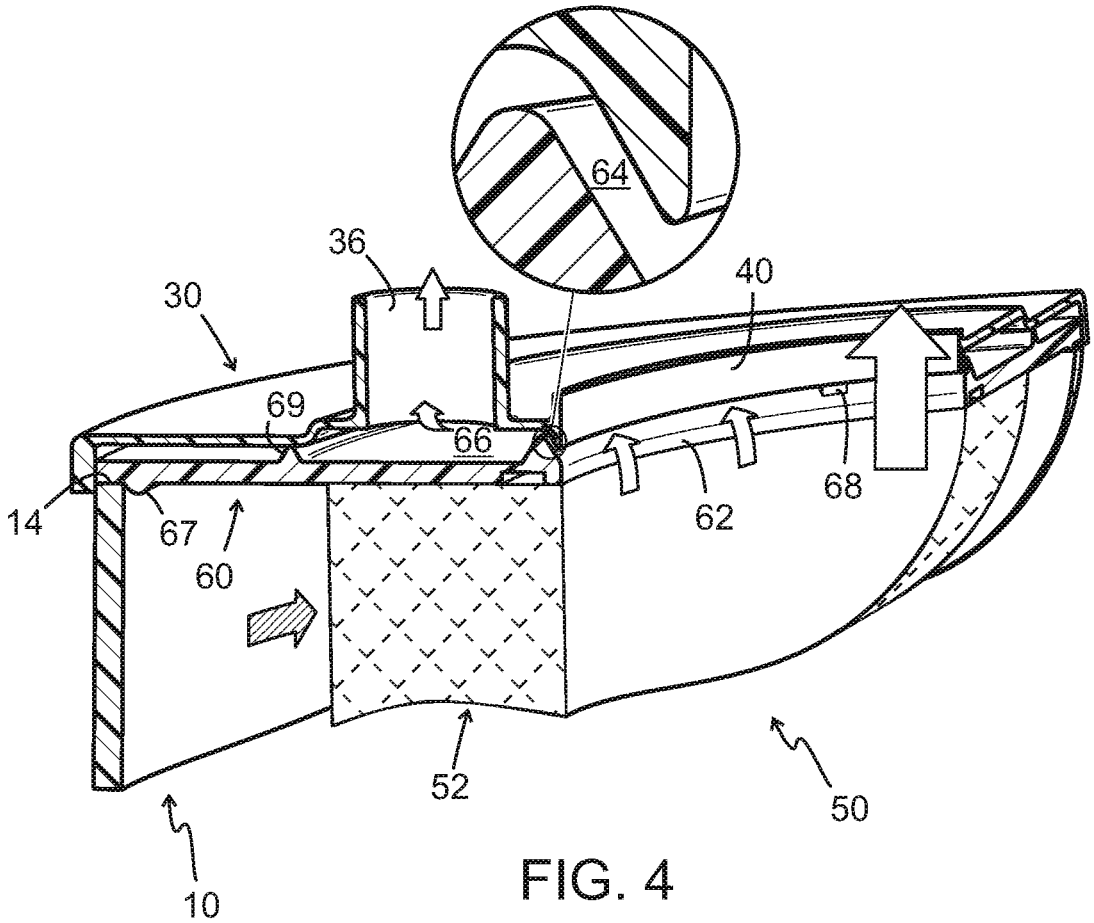
FIG. 4 is a detail view, with portions cut away, of an upper portion of an air filter arrangement according to the invention.

As most clearly depicted in FIG. 4, the filter 52 of the filter unit 50 is connected to a filter top in the form of an upper seal element 60 which has a central aperture 62 coaxial with an inside of the filter 52 and with the air outlet 40. When the filter unit 50 is fitted in the housing 10, the outer periphery of the seal element 60 abuts sealingly against an edge 14 which delineates a top aperture 12 of the housing. Centering means of the housing 10 and/or the filter top 60, e.g. an encircling protrusion 67 directed downwards from the underside of the filter top 60, may facilitate and ensure that the filter top 60 reaches a correct position at the upper side of the housing 10.

Figure 3:
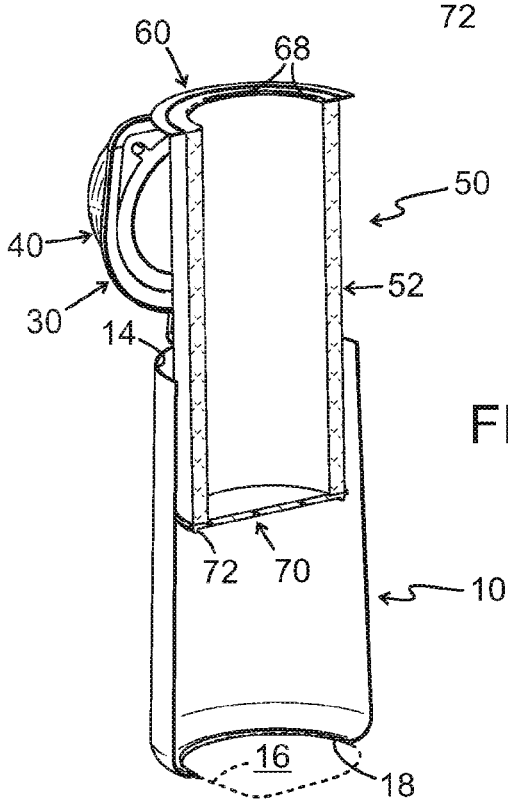
FIG. 3 is a longitudinal sectional view approximately as per FIG. 2 with air filter partly pulled out.

Between the filter unit's 50 upper seal element 60 and the engine air outlet 40 there is an air aperture 64 (FIG. 4) to an extra air outlet 36. As indicated by the arrows in FIG. 4, part of the filtered air may then also be led to an encircling air duct 66 via an air aperture 64 between the cover 30 and the upper seal element 60 before making its way out through the extra air outlet 36. The air duct 66 may be delineated radially outwards by an encircling ridge 69 which is part of the upper seal element 60 and which abuts sealingly against the cover 30. In the example depicted, the extra air outlet 36, which may distribute filtered air in the arrangement to an undepicted air consumer, e.g. an air compressor, is situated in the filter housings 10 cover 30. The air aperture 64 extends along a periphery of the engine air outlet 40, with advantage round the whole periphery, in the form of a gap which slopes obliquely outwards and upwards. The width of the gap may be maintained by supports, e.g. a plurality of evenly distributed bulges 68 which may, as desired, be situated on the upper seal element 60 (FIG. 3) or on the cover 30.

Figure 5:
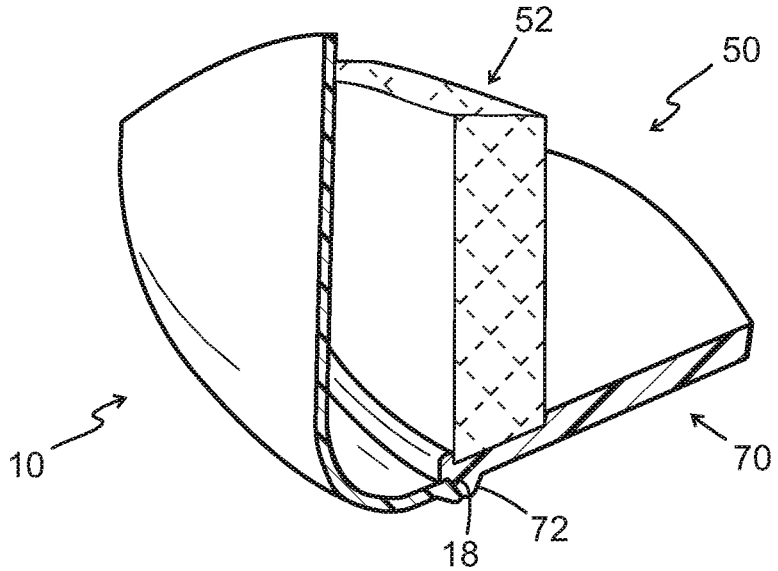
FIG. 5 is a detail view, with portions cut away, of a lower portion of an air filter arrangement according to the invention.

As most clearly illustrated by the simplified depiction in FIG. 5, the filter unit's 50 filter 52 is also connected to a filter bottom in the form of a lower seal element 70. When the filter unit 50 is fitted in the housing 10, the outer periphery of the lower seal element 70 abuts sealingly against a lower circumferential edge 18 which delineates a bottom aperture 16 (FIG. 3) of the housing. This bottom aperture 16 allows dirt, cleaning agents and other particles to make their way out of the housing 10 when it is being cleaned, e.g. on the occasion of change of the filter unit. Centering means of the housing 10 and/or the filter bottom 70, e.g. an encircling protrusion 72 directed downwards from the underside of the filter bottom 70, may facilitate and ensure that the filter bottom 70 also reaches a correct position at the lower side of the housing 10.

Although other solutions are possible, the aforesaid cover 30 in FIGS. 1-3 and FIGS. 6-7 is depicted as being connected pivotably to the filter housing 10 via a hinge 38 situated at an upper outside of the housing 10. The cover's 30 air outlet 40 may further be covered by a filter element 34 (FIG. 2), e.g. a filter cloth and/or a fine-mesh grille, to prevent contaminants and solid particles from entering the air ducts 40, 80 when the cover 30 is open. The cover 30 may be fastened to the housing 10 by suitable connecting means, e.g. undepicted tightening screws or other kinds of fastenings.

Figure 6:
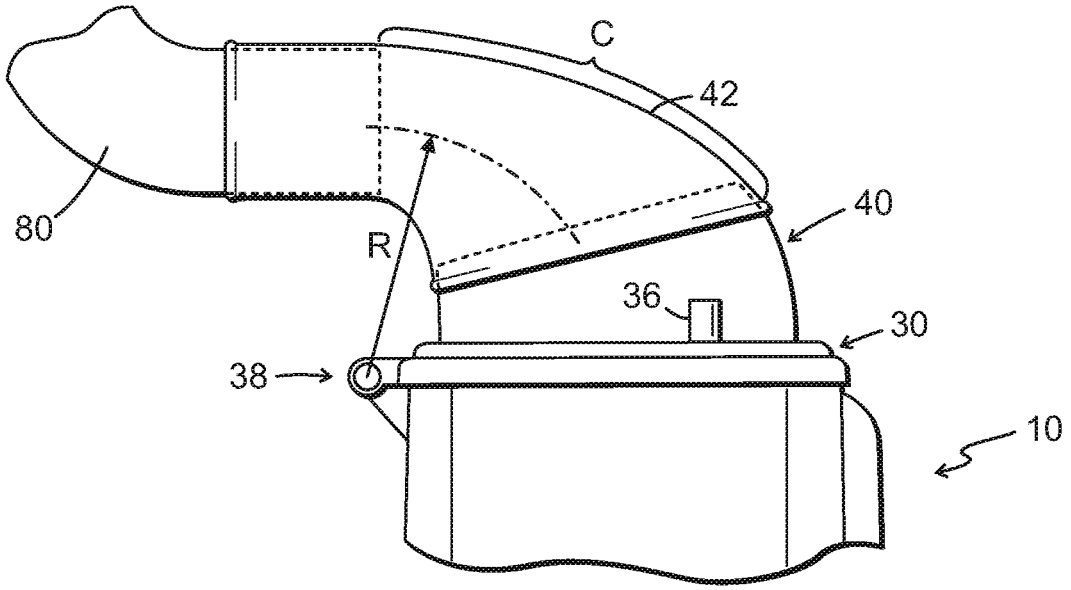
FIG. 6 is a side view with, portions cut away, of an upper portion of an air filter arrangement according to the invention with cover closed.
Figure 7:
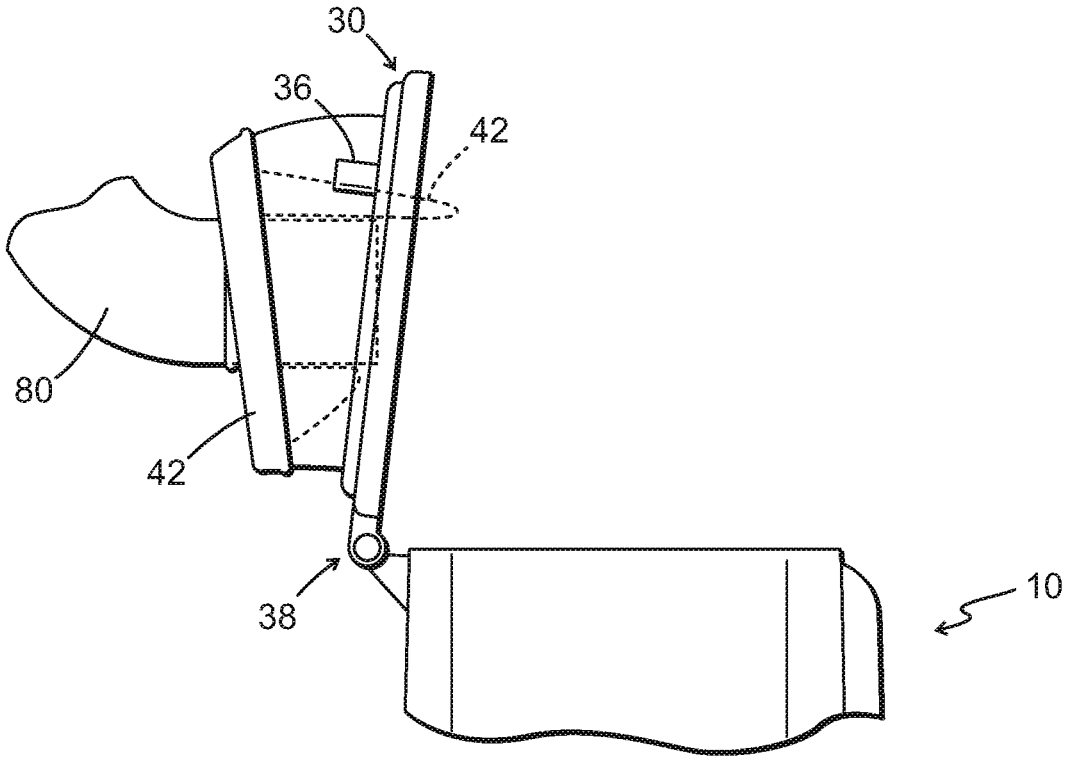
FIG. 7 is a view corresponding to FIG. 6 with cover open.

In the embodiment depicted in FIGS. 6 and 7, the air duct 40 situated nearest to the cover 30 is provided with a collapsible or flexible pipe section 42 which allows repeated opening and closing of the cover 30 without removal from or movement of the fixed air duct 80 situated nearest to the engine. In the embodiment depicted, the pipe section 42 is provided with a narrowing curved portion C made of bendable rubber elastic material which, like a roll bellows, allows the larger cross-section nearest to the cover 30 to be turned inside out, with or without help from a service technician, over the narrowing cross-section nearest to the air duct 80, approximately as depicted in FIG. 7, when the cover 30 is being opened. In a functional state, the pipe section 42 is stretched over the engine air outlet 40 and the air duct 80. A middle line of the curved portion may then extend at approximately constant distance R from the cover's hinge 38.

Figure 8A:
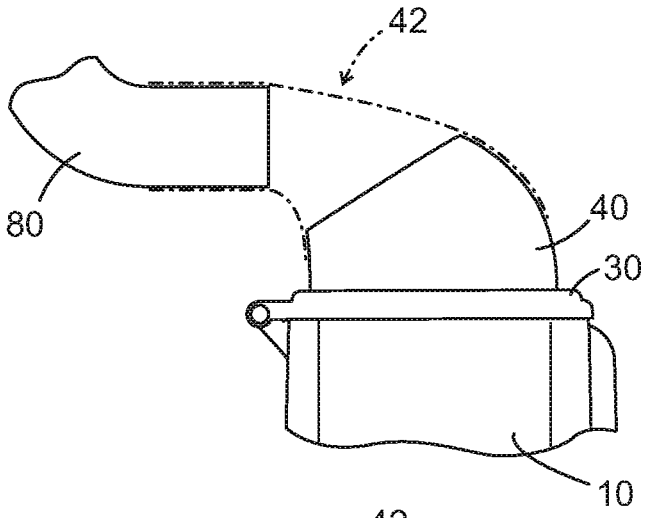
FIGS. 8A-8C depict schematically a process of opening the cover of an arrangement substantially according to FIGS. 6 and 7.
Figure 8B:
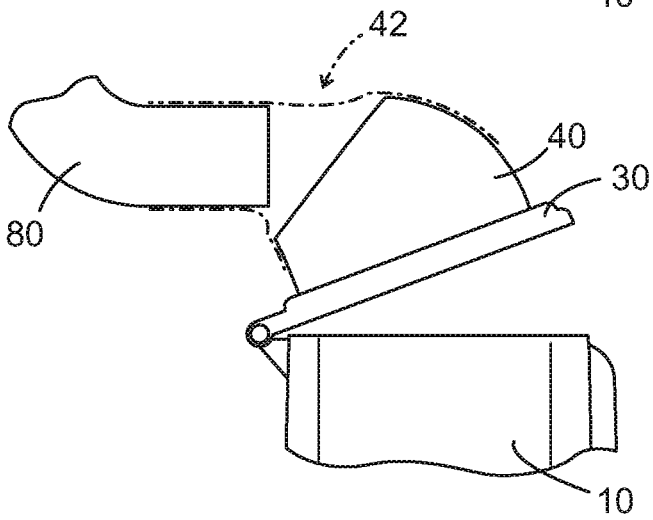
Figure 8C:
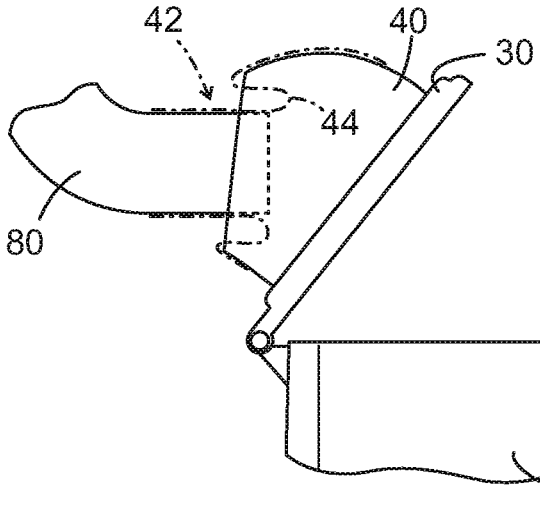

FIGS. 8A-8C depict in more detail an opening process of an arrangement substantially corresponding to that in FIGS. 6 and 7. The air ducts 40 and 80 extend relatively far into the flexible pipe section 42 in order to support it and prevent its collapsing during operation. As indicated in FIG. 8B, the cross-section of the pipe section 42 between the ducts may in various ways, e.g. by material notches or built-in stresses, be arranged to be drawn together somewhat or deformed radially inwards when the cover 30 starts opening. The larger duct 40 connected to the cover 30 will then be situated round and spaced from the narrower duct 80. When thereafter the cover in FIG. 8C approaches the open state which allows an undepicted filter unit to be taken out of the filter housing 10, a roll lobe 44 may naturally form on the portion of the pipe section 42 which is supported on an end portion of the narrower duct 80 so that the pipe section 42 unrolls like a roll bellows on this end portion.

In this and other embodiments, the cover 30 need not necessarily be connected pivotably to the remainder of the housing 10, as it may also in an undepicted way be capable of being completely lifted away from the housing 10.

The detailed description set out above is primarily intended to facilitate understanding and no unnecessary limitations of the invention are to be construed therefrom. The modifications which will be obvious to one skilled in the art from perusing the description may be effected without departing from the concept of the invention or the scope of the claims set out below.

The invention claimed is:

1. An air filter arrangement comprising:

a filter housing connected to an air duct for a combustion engine, the filter housing having a top aperture;

a cover configured for closing the top aperture of the filter housing and the cover being openable, an engine air outlet on the cover;

a flexible pipe section on the engine air outlet and configured for connection to the duct, the flexible pipe section is configured for allowing the cover to be removed from the top aperture;

a filter unit configured to be introduced into and taken out from the filter housing when the housing is connected to the duct;

the pipe section has a curved portion which has a narrowing cross-section that narrows in a direction of air flow toward the air duct from a larger cross-section nearest to the cover to a smaller cross-section nearest to the air duct, the curved portion is made of elastic material and the curved portion is configured to be folded inside out when the cover is moved toward the duct to allow the larger cross-section nearest to the cover to be turned inside out and folded over the smaller cross-section nearest to the air duct when the cover is being opened.

2. An air filter arrangement according to claim 1, wherein the pipe section is configured to be slid over the engine air outlet and the duct.

3. An air filter arrangement according to claim 1, wherein the cover is connected to the filter housing via a hinge.

4. An air filter arrangement according to claim 1, wherein a middle line of the curved portion runs at approximately constant distance from the hinge.

5. An air filter arrangement according to claim 1, further comprising a filter element covering the engine air outlet.

6. An air filter arrangement according to claim 1, wherein the curved portion of the pipe section rolls like a rolling bellow as the cover is opened.

* * * * *